United States Patent [19]

Valli

[11] Patent Number: 4,793,760

[45] Date of Patent: Dec. 27, 1988

[54] AUTOMOBILE PARKING APPARATUS

[76] Inventor: Giovanni Valli, Via Lavizzari, 15, 22070, Rodero (Como), Italy

[21] Appl. No.: 12,349

[22] Filed: Feb. 9, 1987

[30] Foreign Application Priority Data

Feb. 13, 1986 [IT] Italy ..... 19390 A/86

[51] Int. Cl.[4] ..... E04H 6/06

[52] U.S. Cl. ..... 414/254; 414/256

[58] Field of Search ..... 414/253, 254, 255, 256

[56] References Cited

U.S. PATENT DOCUMENTS

| | | | |
|---|---|---|---|
| 2,014,351 | 9/1935 | Becker | 414/254 |
| 2,890,802 | 6/1959 | Alimanestiano | 414/254 |
| 3,301,413 | 1/1967 | Coursey | 104/172.3 X |
| 3,896,955 | 7/1975 | Collins et al. | 414/254 |
| 4,265,581 | 5/1981 | Ives et al. | 414/254 X |

FOREIGN PATENT DOCUMENTS

| | | | |
|---|---|---|---|
| 825846 | 12/1959 | United Kingdom | 414/256 |

*Primary Examiner*—Leslie J. Paperner
*Assistant Examiner*—Stuart J. Millman
*Attorney, Agent, or Firm*—Bucknam and Archer

[57] ABSTRACT

An apparatus includes an automobile transporting carriage constituted by an inner frame, provided with wheels and motors for translation of the carriage along rails and slidingly coupled, for vertical displacement, to an outer frame not overlying the region covered by the inner frame, the outer frame having a set of comb-like teeth for supporting the wheels of an automobile, which teeth can be intercalated with teeth of a fixed rack, to enable the carriage to pick up an automobile from the fixed rack by raising the outer frame with the teeth thereof passing between the teeth on the fixed rails, or likewise deposit it on the fixed rack by lowering the outer frame.

4 Claims, 9 Drawing Sheets

AUTOMOBILE PARKING APPARATUS

BACKGROUND OF THE INVENTION

A mechanised parking system for automobiles must be reliable, of low cost and the speed of parking or retrieval of vehicles must not be unduly slow.

Various types of mechanised automobile parking apparatus are known, which can be divided into three principle types. The first type acts to convey vehicles between a pick-up station and a plurality of storage stations, on a carriage which in use is thrust under one end of the vehicle and which, by means of appropriate gripping elements, urged or rotated under two of the wheels (either front or rear wheels), conveys the vehicle simply by pushing or pulling it, or by raising and pushing or pulling on these wheels. In either case the vehicle still rolls on at least two of its own wheels. Generally, there is also provided a centering device which acts on the two wheels of the vehicle which are not directly engaged by the gripping elements of the carriage. This centering device serve to position the vehicle in alignment with the axis of the carriage and, sometimes, is completely separate from the carriage. The advantage of centering the wheels of the vehicle with respect to the carriage is that of being able to park the vehicle in a narrow space without risk of damage to the vehicle.

However, because these known systems rely on the rolling of two or four of the wheels of the vehicle itself during its movement problems can be encountered if the user has inadvertently left the handbrake on, or if the gears are left engaged. Moreover, problems are also encountered in gripping the wheels if these are partially or totally deflated. Mechanised automobile parking systems of this type thus exhibit a low reliability in operation even though the mechanised parts of such systems are, in themselves, entirely reliable. In addition to this, the mechanical complexity of the mechanisms for engaging and raising the motor vehicle generally involves high production and maintenance costs.

Another known system provides for the utilisation of pallets on which the motor vehicles are carried, to be deposited in appropriate stalls or compartments. Such pallets therefore have the great advantage of completely raising the vehicle off its wheels and therefore do not rely on the vehicle's own wheels for rolling. When the user arrives to park he must drive his own vehicle directly over the pallet which, by means of a pallet carrier carriage, suitably positioned by an elevator or transelevator, is mounted longitudinally or transversely and introduced directly.

This involves the adoption of a device for exchanging pallets in such a way that whenever a pallet with a motor vehicle is taken off, arrangements are made for its replacement by depositing an empty pallet on the pallet carrier carriage. The lack of a centering device in such systems makes the utilisation of larger surfaces necessary, whilst the necessity of replacing the pallet supporting the automobile when this has been conveyed to the storage station with an empty one for the next vehicle implies the utilisation of greater height. Moreover, the necessity of having a pallet for each storage station involves a considerable increase in production costs.

Another known mechanised automobile parking system provides for the utilisation of movable frames with metal elements having the form and disposition of the teeth of a comb, or else carriages carrying movable comb-like frames. Such systems require the utilisation of frames which are fixed with respect to the movable frames, and the presence of combs anchored in the storage stations, through which the teeth of the movable combs pass with a vertical movement to deposit or retrieve the vehicle, for which purpose it is necessary to provide for the fixed teeth to be approached by the frame having movable teeth, after this has arrived in a position such as to be able to be lowered, thus releasing the vehicle (or to be raised thus retrieving the vehicle) and, this consequently, must be achieved with a movement parallel to the axis of the teeth or with a movement orthogonal to the axis of the teeth themselves.

Such systems convey the automobile either in a longitudinal direction, along the axis of movement of the automobile, or in a transverse direction, that is to say perpendicular to the axis of movement of the automobile. Like the pallet systems, comb systems have the favourable characteristic of raising all four wheels of the vehicle from the ground. The problems which such systems present are essentially due to the lack of mechanical centering of the vehicle, so that other things being equal, it is necessary to provide a greater surface area at the storage station than in the case of systems of the first mentioned type. Also the carriages have a considerable height due to the fact that the lifting mechanism is mounted onto the carriage.

Other known mechanised parking systems, instead of storing the vehicles at fixed locations, keep them in circulating movement. Such systems do not have actual storage stations for the automobiles, but each pallet or frame on which the user has left an automobile is used for recovery of the vehicle itself and is continuously moved, together with all the other vehicles, to bring the various empty pallets or support frames successively to the vehicle deposit or retrieval positions.

This type of apparatus has the serious defect of being extremely slow, and because it provides the contemporaneous movement of all the vehicles, involves a considerable expenditure of energy.

OBJECTS OF THE INVENTION

The primary object of the present invention is that of eliminating the previously indicated disadvantages by providing apparatus which will give the possibility of using smaller transport and storage spaces thus contributing to a significant reduction in the associated costs.

Another object of the invention is to provide automobile parking apparatus having a great operating reliability, this being due in part to the built in redundancy of the design, by providing more motors and devices for the movement of the apparatus than are strictly required.

A further object of the present invention is to provide automobile parking apparatus which will have a low manufacturing and maintenance cost, together with a very great versatility of application.

Still a further object of the present invention is to provide apparatus which is easily usable by the users.

SUMMARY OF THE INVENTION

The automobile parking apparatus of the invention includes a carriage for the transport of wheeled vehicles, constituted by an inner frame provided with wheels and motors for the translation of the carriage, an outer frame which does not overlie the inner frame, and which is connected to the inner frame by means for displacing the outer frame vertically with respect to the inner frame, the said outer frame having comb-like teeth for supporting the wheels of a vehicle, which teeth can be intercalated with the teeth of a fixed rack whereby to enable the carriage to deposit a vehicle on the fixed rack or to retrieve it therefrom by means of the said vertical displacement of the outer frame.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Figure 1:
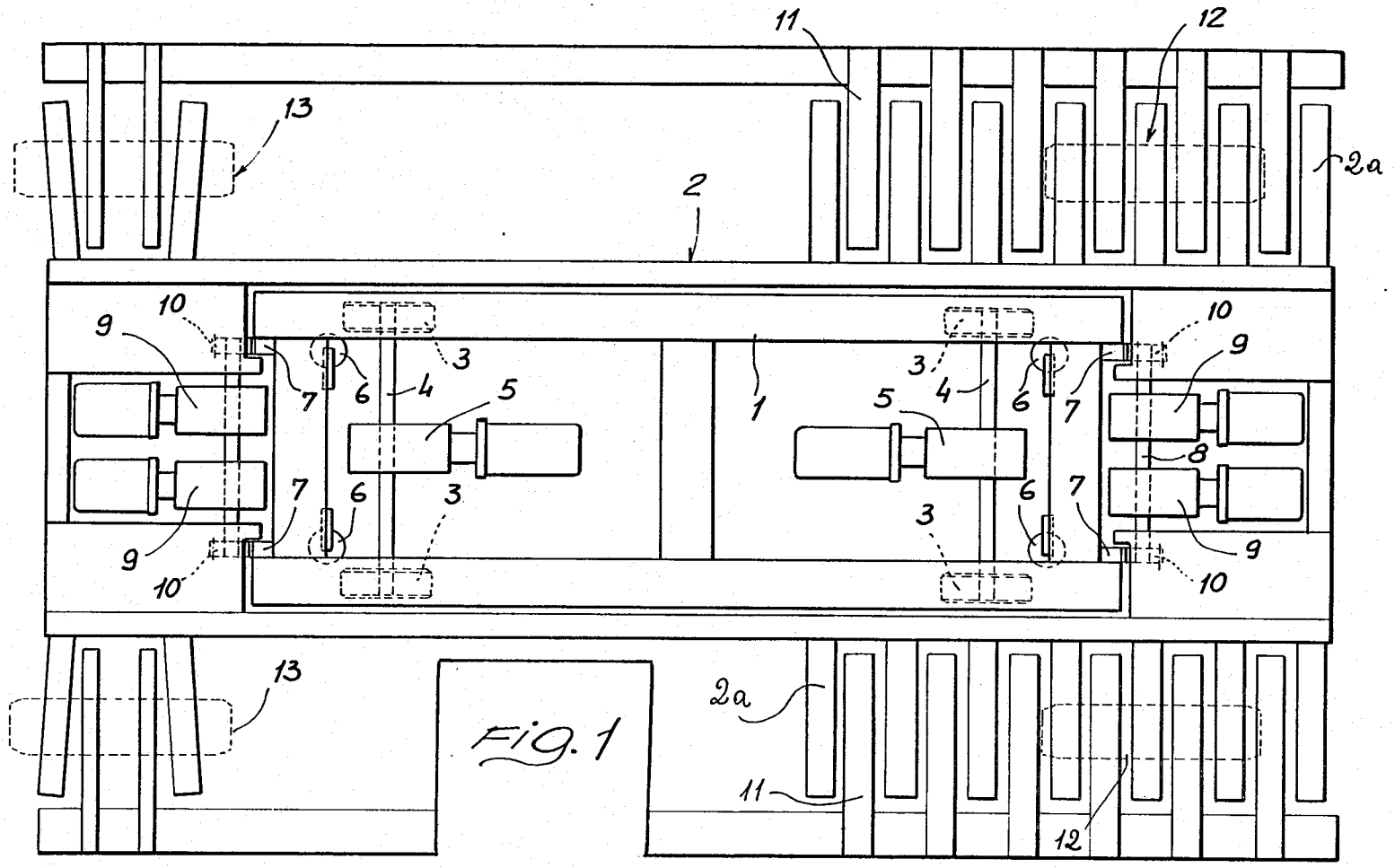
FIG. 1 is a plan view of a transport carriage forming part of the apparatus of the invention.

With reference now to the drawings, the apparatus for mechanised parking of vehicles comprises a wheeled vehicle transport carriage which is substantially constituted by an inner frame 1, an outer frame 2 which is displaceable in a vertical direction with respect to the inner frame, by means which will be described hereinbelow, and which is shaped in such a way as not to interfere with the region overlying the inner frame. The inner frame 1 is provided with four wheels 3, which are driven by shafts 4, themselves driven by two hollow shaft geared motors 5. The inner frame also has guide rollers 6, and is provided, at its ends, with four vertical racks 7 which serve to support the outer frame via pinions in a manner which will be described in more detail below.

The outer frame, as mentioned, does not interfere or overlap with the inner frame, at least not in correspondence with the vertical displacement means constituted by the racks 7 and pinions 10, which latter are driven to rotate by shafts 8 driven by four hollow shaft geared motors 9. The motors 5 and 9 have built in redundancy in the sense that the functions which they perform could be performed with only a single translation motor 5 and two individual raising motors 9.

The outer frame 2 has a plurality of outwardly directed comb-like teeth 2a for the support of the wheels of a motor vehicle which teeth can be intercalated with the teeth of a fixed rack 11. Such fixed racks 11 are provided in the various stalls or compartments in which the vehicles are placed for storage, and in the pick-up and retrieval stations as will be described.

The wheels of a motor vehicle to be carried are indicated 12 and 13; whatever the wheelbase of the vehicle two of its wheels are always located in the position illustrated by the wheels 13, whilst the wheels illustrated by the wheels 12 may adopt a different position in dependence on the wheel base of the vehicle being moved.

Figure 2:
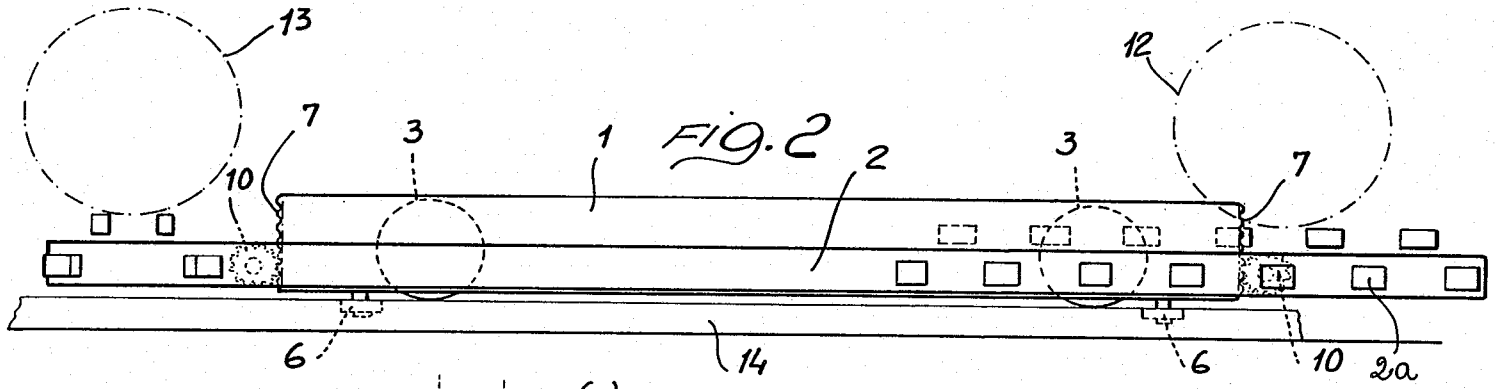
FIG. 2 is a side view of the carriage illustrated in FIG. 1, with the outer frame in the raised position.
Figure 3:
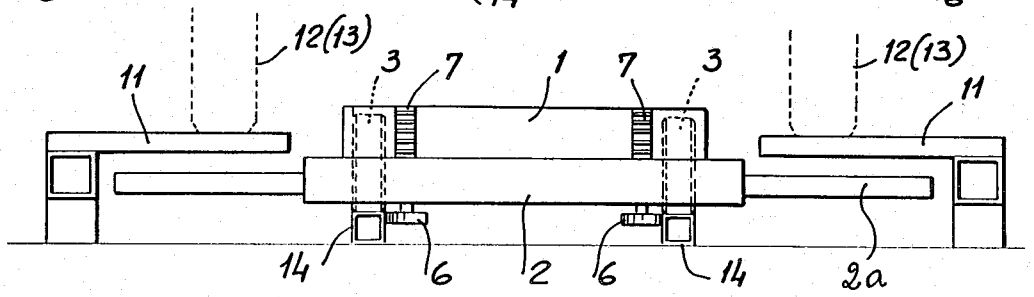
FIG. 3 is an end view of the carriage of FIG. 1, with the outer frame in the lowered position.
Figure 4:
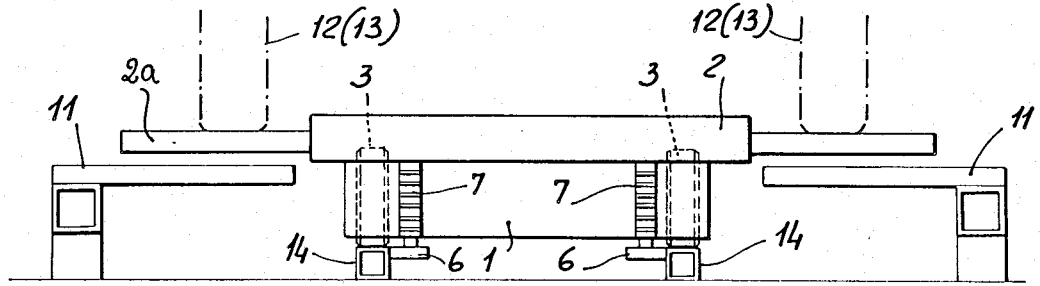
FIG. 4 is an end view of the carriage of FIG. 1 with the outer frame in the raised position.

The rollers 6, which have a vertical axis, engage guide rails 14, as is seen in Figures from 2 to 4, the carriage being illustrated with the outer frame in lowered position in FIG. 2 and FIG. 3, and with the outer frame in the raised position in FIG. 4, in which latter position the wheels 12 and 13 of the vehicle engage with the comb-like teeth of the outer frame, and are raised above the teeth 11 of the fixed rack.

Figure 5:
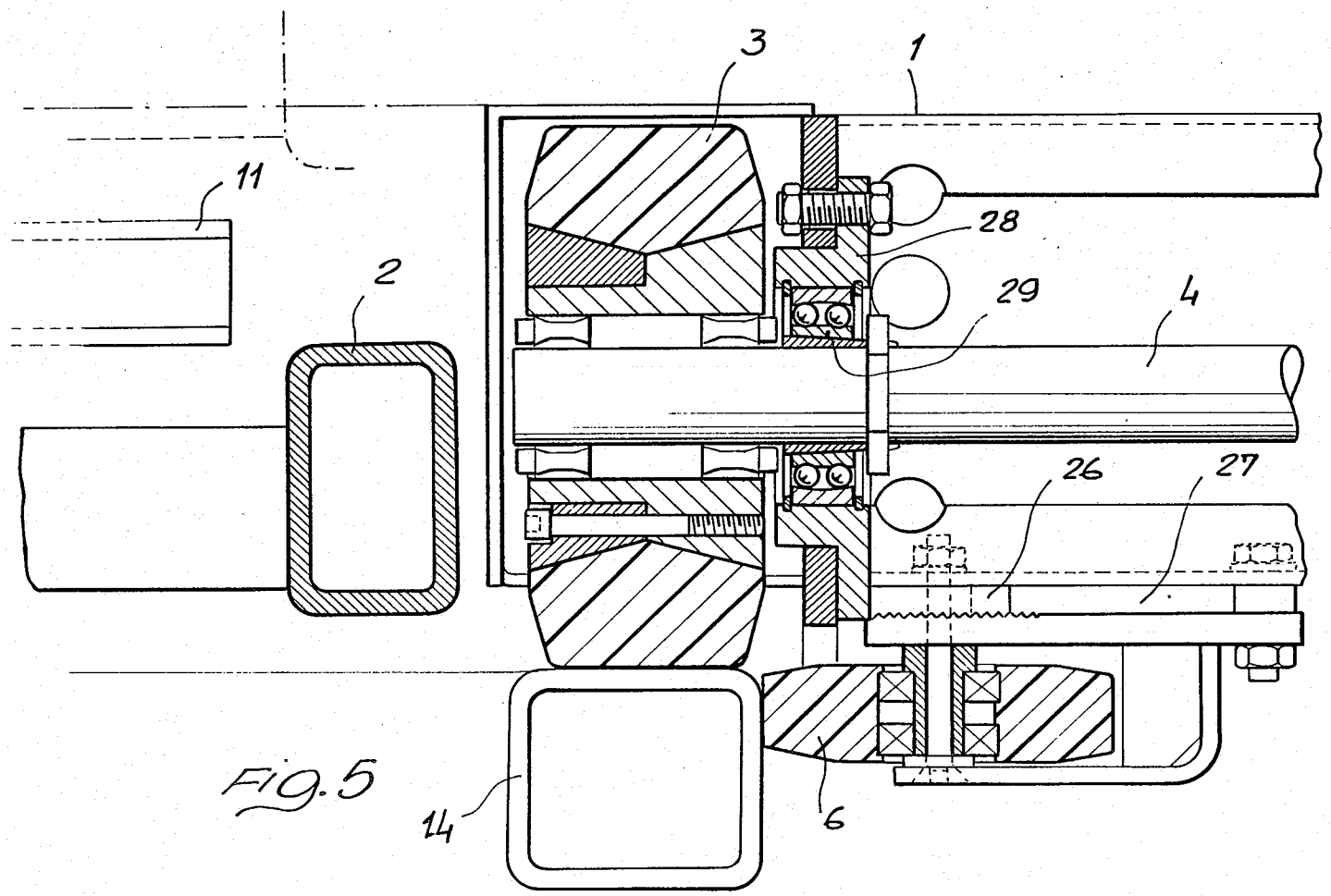
FIG. 5 is a section showing a detail of the transport wheels of the carriage.

As seen in FIG. 5 the transport wheels 3 of the inner frame are carried on axles 4 each of which is connected, by means of a bearing 29, to a bearing carrier flange 28 fixed to the inner frame 1. The rollers 6, which engage with the rails 14, are connected by adjustment means indicated 26 and 27.

Figure 6:
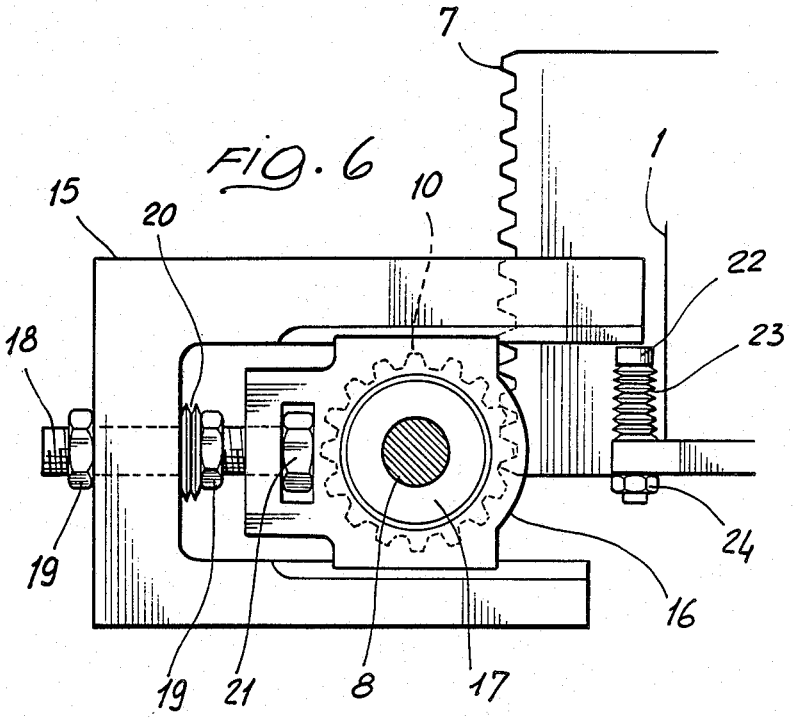
FIG. 6 is a detail view illustrating the means for effecting vertical movement of the outer frame with respect to the inner frame.

In FIG. 6 are indicated the means for vertical displacement of the outer frame with respect to the inner frame. Such means include the pinion 10 carried on the shaft 8 by a bearing 17 carried by a bearing carrier 15 fixed to the outer frame. The bearing 17 has an outer casing 16 the position of which can be adjusted laterally with respect to the bearing carrier 15 by means of a threaded rod 18 axially movable by means of two nuts 19, and which transfers its movement to the bearing casing 16 via a nut 21. A set of cup springs or belleville washers 20 are provided to enable a certain pressure to be applied between the pinion 10 and the rack 7 to maintain meshing engagement. These springs, which obviously must not be completely compressed, also have the function of absorbing horizontal inertia along the direction of movement upon changes in the speed of the carriage. The springs 20 also perform the function of regulating the distance existing between the front and rear pairs of pinions to avoid wedging and breakage. There is further provided a mechanical end stop constituted by a screw 22, a spring 23 and a nut 24, which interact with the bearing carrier 15 to determine its lowered position.

Figure 7:
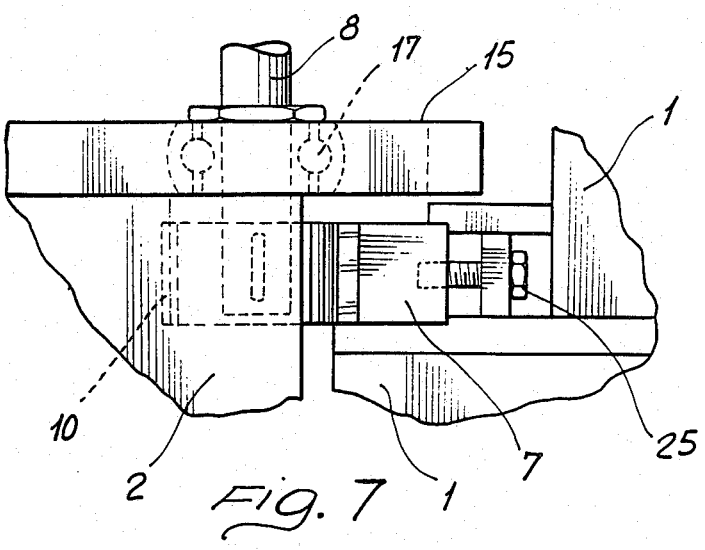
FIG. 7 is a plan view showing the position of the vertical motion means between inner and outer frames.

The screw 25, illustrated in FIG. 7, acts as an element for positioning the rack 7, whilst the position of the outer frame with respect to the inner frame is obtained by the pinions 10 which allow no relative translation in the transverse direction between the outer frame and the inner frame.

Figure 8:
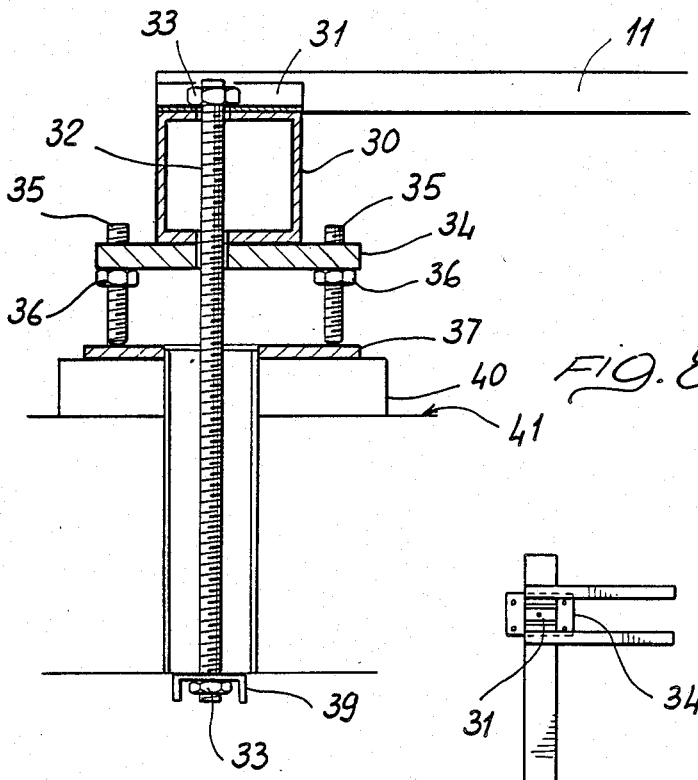
FIG. 8 is a partially sectioned view of a fixed rack.

As indicated above, the apparatus includes fixed racks each of which is anchored to the ground, by means of a concrete pad 41 as is better illustrated in FIG. 8. The framework of the fixed frame is composed of a box-section metal tube 30 to which are welded the teeth 11 of the fixed rack. The metal tube, preliminary positioned upon casting of the pad 41, allows the positioning of the tube 30 horizontally in the plane of the pad, whilst a system constituted by threaded rods 32, nuts 33, and concentrated force diffusers 31 and 39 ensure a rigid and secure fixing of the assembly by means of the pre-tension of the threaded rod 32, against a plate 34 located by screws 35, nuts 36, plates 37 and concrete pad 40.

Figure 9:
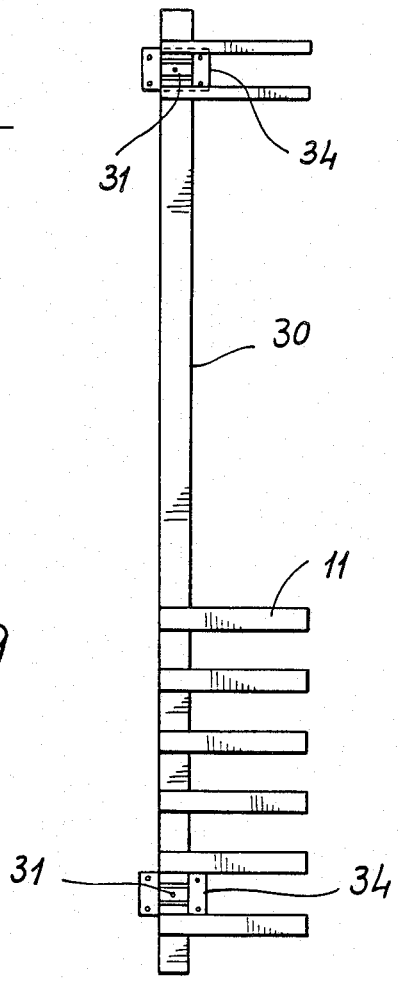
FIG. 9 is a plan view of the fixed rack of FIG. 8.

The screws 35 and nuts 36 allow the height of the tube 30 and inclination to the horizontal of the plane formed by the axes of the teeth 11 to be adjusted. FIG. 9 shows the general conformation in plan of a fixed rack, which has fixed comb-like teeth disposed in such a way that they can be intercalated with the teeth formed on the outer frame 2.

Figure 10:
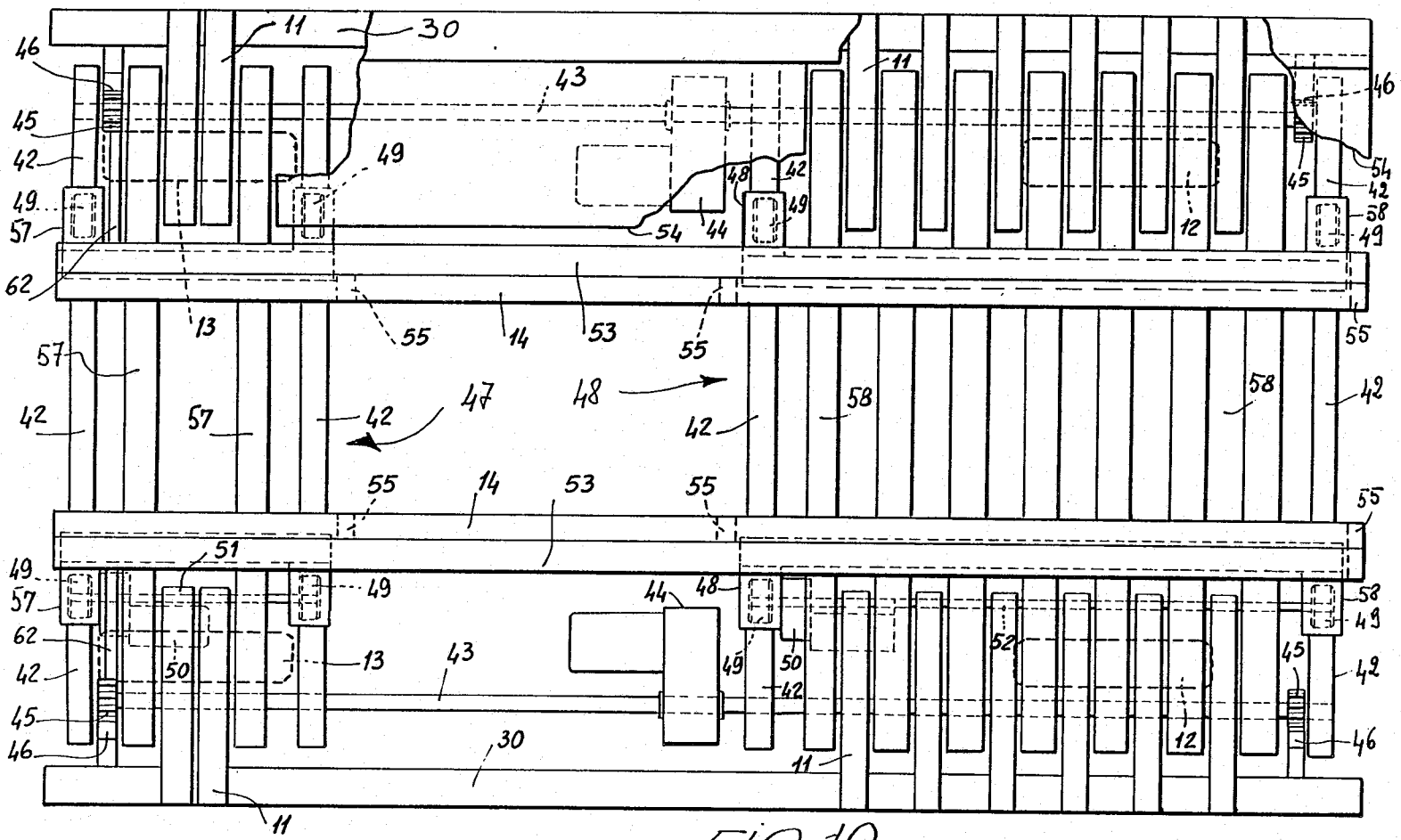
FIG. 10 is a plan view of the centering device.
Figure 11:
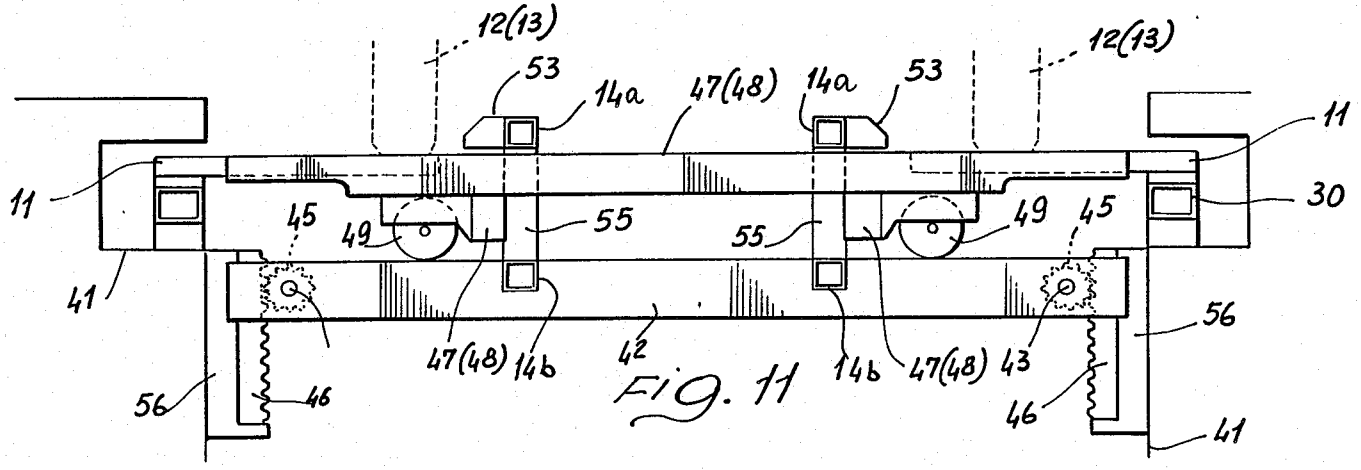
FIG. 11 is an end view of the centering device.

The apparatus further includes a centering device better seen in FIG. 10. The centering device includes a base frame 42 movable vertically by the action of two hollow shaft geared motors 44 mounted on axles 43, which drive four pinions 45 acting on four racks 46 fixed to the outer structure of the centering device and adjustable by means not shown. Transversely on the base frame 42 move two centering carriages, a front carriage 47 and a rear carriage 48. The carriages are each driven by a hollow shaft geared motor 50 which drives a front shaft 51 and rear shaft 52, which drive two or four wheels 49 of each individual centering carriage 47 and 48. The upper plane of the centering carriages 47 and 48 is formed by metal transverse elements 57 and 58 respectively, between each of which is an empty space in such a way as to be able to traverse the teeth of the fixed rack 11 during vertical movement. On the frame 42 there are fixed centering elements 53 carried on upper longitudinal supports **14*a* which are carried on uprights 55 supported on lower longitudinal supports 14*b* (See FIGS. 11 and 12) fixed to the base frame 42, which are independent of the transverse carriages 47 and 48**.

At one end of the centering device there are provided wheel stop elements indicated 62 secured to the fixed frame. Against the elements 62 the user must stop the motor vehicle when he drives onto the centering device for parking. The centering device is covered with a covering of sheet metal, generally indicated 54. The user must first drive the vehicle onto the centering device.

At this point the teeth of the fixed rack 11 form a single plane with the grating of the transverse centering carriages 47 and 48 in such a way that the user can drive his vehicle without difficulty up to the required position. The base frame 42 is then moved vertically by rotating the pinions 45 which act on the racks 46 supported by the rack carrier adjustment plate 56 anchored into the concrete 41.

Figure 12:
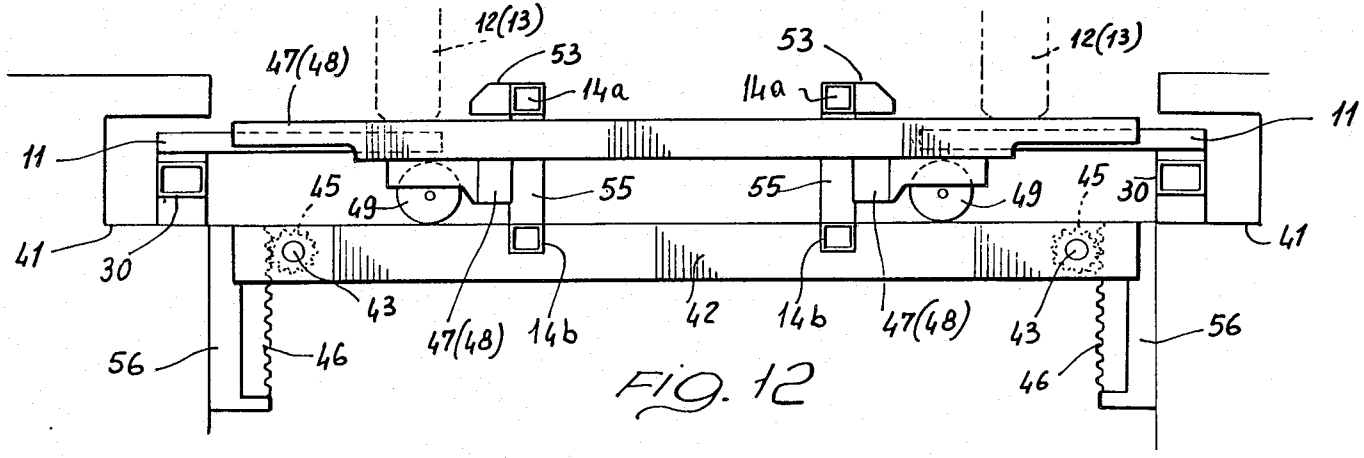
FIG. 12 is an end view of the centering device, shown in a raised position.

As is shown in FIG. 12, after the user has left the vehicle, the centering stage is commenced with the raising of the wheels of the vehicle 12 and 13 from the fixed comb-like teeth 11. This is caused by the raising of the base frame 42 which carries the two centering frames 47 and 48 which, by means of their teeth elements, pass through the fixed combs 11 and raise the vehicle. At this point the vehicle is not positioned centrally as can be seen in FIG. 12.

Figure 13:
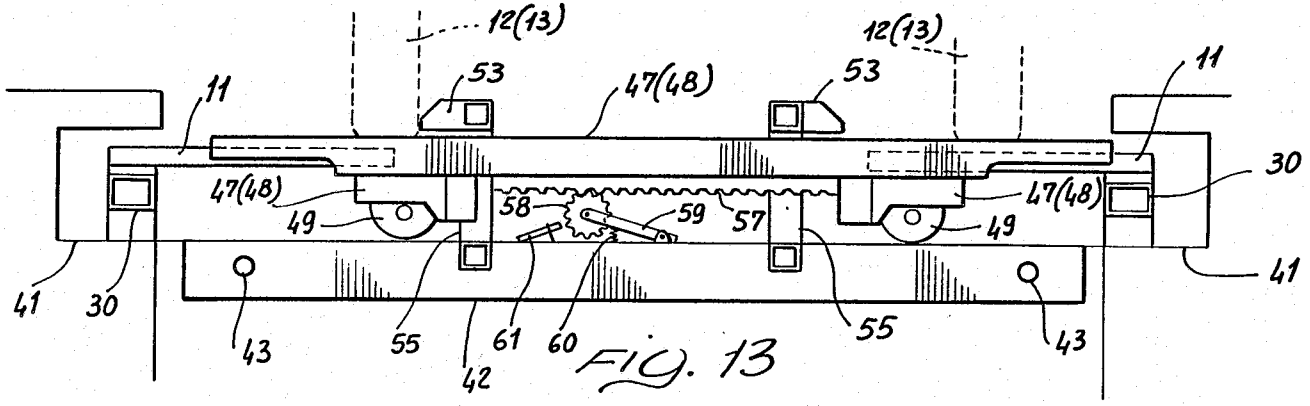
FIG. 13 is an end view of the centering device shown in a position adopted during the centering operation, acting on a wheel on one side of a vehicle.

Subsequently, as is illustrated in FIG. 13, the carriages 47 and 48 move, independently of one another, laterally with their wheels 49 supported and guided on the base frame 42. The said carriages 47, 48 move in transverse directions normal to the direction of movement of the vehicle, and in the same sense, each stopping when the corresponding wheel contacts against the longitudinal metal abutment strip 53. In other words, the front transverse carriage 47 will stop after the front wheel 13 of the vehicle comes into contact with the strip 53, whilst the rear transverse carriage 48 will continue after the carriage has stopped, until the rear wheel contacts the strip 53 this stopping will be determined by the pressure caused by the wheel on suitable sensors positioned on the longitudinal metal strip 53, or by detection of the greater consumption of current of the driving motor of the individual transverse carriage following the stopping of the wheel against the strip 53.

Figure 14:
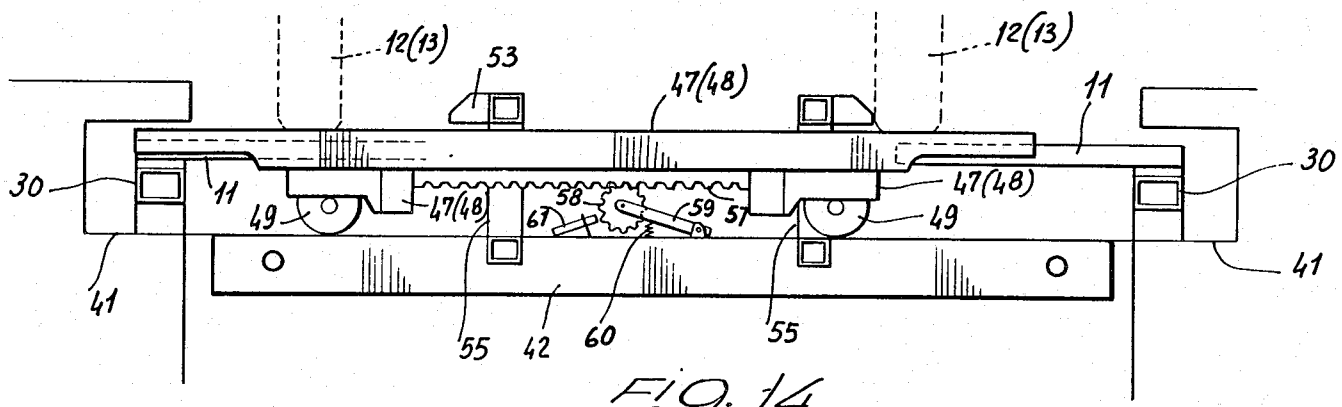
FIG. 14 is an end view of the centering device shown in a position adopted during the centering operation, acting on the wheel on the opposite side of the vehicle.

At the end of this stage, the two wheels 12 and 13 on the sam side of the vehicle will be aligned with the longitudinal metal strip, although it is not possible to say (because of the possible difference in the wheel track between the front wheels and the rear wheels of the vehicle) that the other wheels will be aligned, or that the longitudinal axis of the vehicle will be parallel to that of the centering device. At this point, as is shown in FIG. 14, the two transverse carriages 47 and 48 move in the opposite direction from that previously described, stopping in the same way when the corresponding wheels 13 and 12 engage against the other longitudinal metal strip 53. Contemporaneously, whilst the translation of the two carriages is taking place, a measurement of the distance travelled by them both is effected. This is obtained with a simple device positioned both on the front carriage 47, and on the rear carriage 48, constituted by a rack 57 fixed to the centering carriage, which moves a pinion 58 fixed on the base frame 42 by means of a lever 59 and a spring 60, which holds it in position against the rack. A proximity sensor counts the teeth of the pinion which pass before it and makes it possible to know the position of the centering carriage at any instant, also measuring the distance travelled during a certain movement.

Figure 15:
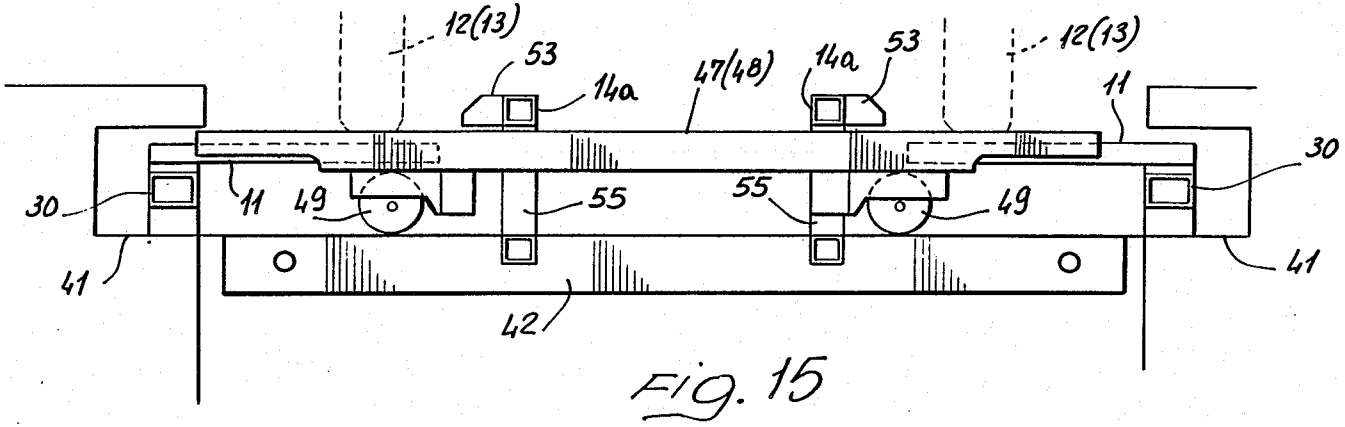
FIG. 15 is an end view of the centering device showing the parts once centering has been effected.

At the end of this stage it is possible to know the net internal distances respectively between the two front wheels and the two rear wheels. As illustrated in FIG. 15, the final centering stage is then effected, in which the two carriages 47 and 48 are displaced transversely in the opposite sense from that described in relation to the preceding Figure, until they are positioned in an exactly mid position, that is to say with a displacement equal to one half of the measured displacement. At the end of this stage, both the front wheels 13 and the rear wheels 12 of the vehicle are located in a symmetrical position with respect to the central longitudinal axis of the centering device.

Figure 16:
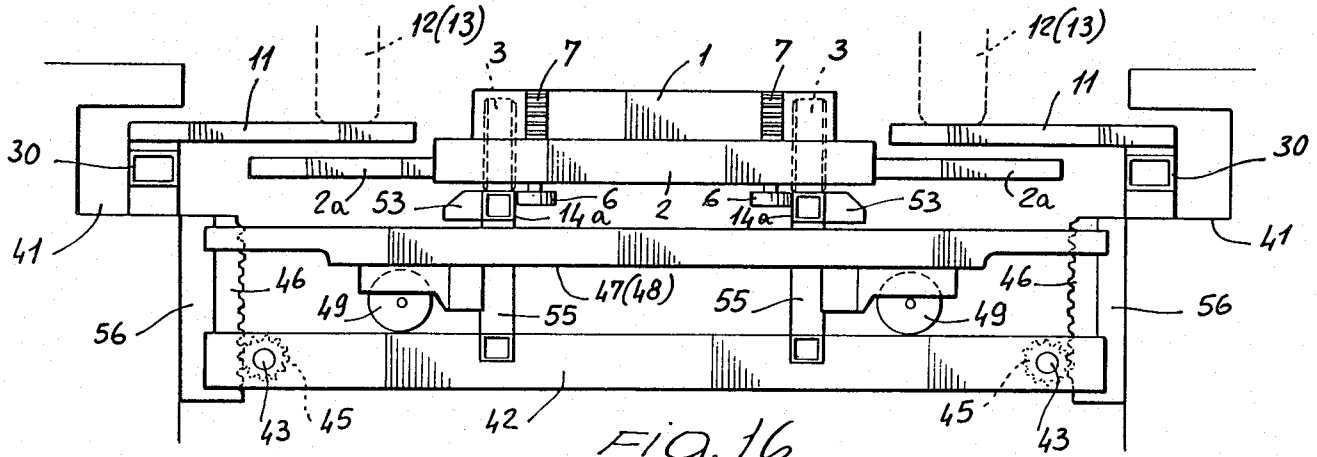
FIG. 16 shows the centering device in lowered position, showing the transport carriage in position.

As is shown in FIG. 16, once the centering stage has been effected the base frame 42 is lowered, carrying with it the displacement carriages 47 and 48, and the centering strips 53, whilst the upper longitudinal supports **14*a*, also supported by the base frame 42, stop in a position such as to allow the transport carriage, which can come under the centering device, to be positioned under the motor vehicle and there raised as described above, to lift the vehicle off the fixed rack 11** ready to take it to a storage location or stall (not shown).

The apparatus of the invention is thus able to effect the pick-up and transport of vehicles in a perfectly centering position, also following, if required, curved tracks, therefore having the possibility of optimising all the stages inherent in the storage of vehicles.

Moreover, the height is very limited and all the operations are rapid and can be easily performed directly by the user who is required only to drive his vehicle onto the centering device.

What is claimed is:

1. An automobile parking apparatus comprising:

a carriage for transporting automobiles between a deposition and retrieval station and a plurality of storage stations, said carriage being constituted by an inner frame and an outer frame, a plurality of wheels on said inner frame carrying said carriage on rails, a plurality of motors on said inner frame or driving said wheels, said outer frame being shaped so that it does not overlie said inner frame, vertical displacement means for displacing said outer frame vertically with respect to said inner frame, automobile support means on said outer frame having comb-like teeth projecting from said outer frame for supporting the wheels of an automobile, said deposition and retrieval station and said storage station having automobile support means comprising a plurality of comb-like teeth between which said comb-like teeth of said outer frame automobile support means can pass as said outer frame is raised or lowered, whereby to enable said carriage to deposit an automobile on a fixed rack or to retrieve it therefrom by vertical lowering or raising displacement of said outer frame, said inner frame being provided with first wheels having a horizontal axis and second wheels having a vertical axis engaging with guide rails, wherein said first and second wheels of said inner frame are arranged in the region defined by said outer frame, said apparatus further including automobile centering means operating to align the longitudinal axis of a automobile with that of said carriage, said automobile centering means having a base frame supporting a front centering carriage and a rear centering carriage independently engageable by the front and rear wheels of an automobile on said centering means, each said centering carriage being independently laterally displaceable with respect to said base frame.

2. An automobile parking apparatus according to claim 1, wherein said base frame supports longitudinal guides provided with longitudinal strips against which the inner sides of the wheels of an automobile on said centering means abut as said centering, whereby to detect the position of said automobile on said centering means.

3. An automobile parking apparatus according to claim 1, further including control means for causing lateral displacement of said front and rear centering carriages first in one direction and then in the other, transversely of said longitudinal axis of said base frame, said control means including means for calculating the displacement required to position the front wheels and the rear wheels of the automobile on said centering carriages centrally with respect to said longitudinal guides.

4. An automobile parking apparatus according to claim 1, wherein said longitudinal guides of said base frame are aligned with said guide rails upon lowering of said base frame after centering has been effected, whereby to allow said transport carriage to be introduced under said fixed racks to pick up an automobile therefrom by raising of said outer frame of said carriage.

* * * * *